United States Patent [19]

Tolley et al.

[11] 4,152,252

[45] May 1, 1979

[54] PURIFICATION OF RUTILE

[75] Inventors: William K. Tolley; Beckay J. Nelson, both of Arlington Heights, Ill.

[73] Assignee: UOP Inc., Des Plaines, Ill.

[21] Appl. No.: 902,630

[22] Filed: May 4, 1978

[51] Int. Cl.[2] ..... B03D 3/06

[52] U.S. Cl. ..... 209/10; 209/5; 210/51; 423/83

[58] Field of Search ..... 209/5, 10; 210/51–53; 423/80, 82, 83; 75/1 T; 106/300

[56] References Cited

U.S. PATENT DOCUMENTS

| | | | |
|---|---|---|---|
| 1,937,037 | 11/1933 | Hanahan | 209/5 |
| 2,437,164 | 3/1948 | Kramer | 209/5 |
| 3,220,867 | 11/1965 | O'Shaughnessy | 106/300 |
| 3,446,348 | 5/1969 | Sennett et al. | 209/5 |

*Primary Examiner*—Ralph J. Hill

*Attorney, Agent, or Firm*—James R. Hoatson, Jr.; Raymond H. Nelson; William H. Page, II

[57] ABSTRACT

Rutile which has been separated from ilmenite during a process for obtaining titanium metal values may be recovered in a more simple manner by effecting the water wash of the solid rutile at a pH above about 7.

10 Claims, No Drawings

PURIFICATION OF RUTILE

This invention relates to a method for treating the rutile product which is obtained during the treatment of ilmenite in a more simple manner. More particularly, the invention is concerned with an improvement in a method for treating rutile which has been separated from ilmenite whereby said rutile may be obtained in a form which is more readily handled during the subsequent steps for obtaining titanium dioxide.

Titanium in metallic form or as a compound is an important element in the chemical series. For example, titanium dioxide is utilized in paint pigments, in white rubbers and plastics, floor coverings, glassware and ceramics, printing inks, as an opacifying agent in papers, etc. Other titanium compounds are used in electronics, as fire retardants, waterproofing agents, etc. The metal may be used as such, or in alloy form as structural material in aircraft, in jet engines, marine equipment, textile machinery, surgical instruments, orthopedic appliances, sporting equipment, food handling equipment, etc. When attempting to separate titanium dioxide from impurities such as ilmenite, iron oxides, etc., which are also contained in the titanium bearing source such as ores, the separation is relatively difficult to effect whereby relatively low yields of titanium dioxide in a pure form are obtained. However, it has now been discovered that the separation of rutile, which is titanium dioxide, from ilmenite or ilmenite ores which is a compound of ferrous oxide and titanium dioxide, may be accomplished in a relatively simple manner by utilizing the process hereinafter described in greater detail. The advantage of utilizing the process of the present invention is found in the fact that it is possible to obtain a high degree of rutile recovery using relatively low grade ilmenite ore as the starting material.

It is therefore an object of this invention to provide an improved process for the production of titanium dioxide values.

A further object of this invention is to provide a beneficiation process for obtaining high yields of titanium dioxide values from titanium bearing sources.

In one aspect an embodiment of this invention resides in a method for the separation of rutile which comprises the steps of agitating a slurry of leach tails containing a mixture of ilmenite and rutile, allowing said slurry to settle, decanting the suspended rutile from the settled ilmenite, adjusting the pH of the decanted, suspended rutile solution to effect the flocculation of said rutile; and recovering the flocculated rutile.

A specific embodiment of this invention is found in a method for the separation of rutile which comprises agitating a slurry of leach tails containing a mixture of ilmenite and rutile at a pH in the range of from about 2 to about 4, allowing said slurry to settle, decanting the suspended rutile from the settled ilmenite, adjusting the pH of the decanted suspended rutile solution to a pH in the range of from about 7.1 to about 10 by adding thereto sodium hydroxide whereby said rutile is flocculated and recovering the flocculated rutile.

Other objects and embodiments will be found in the following further detailed dsecription of the present invention.

As hereinbefore set forth the present invention is concerned with an improvement in a method for effecting the treatment of rutile. In one method of effecting the recovery of titanium values from a titanium bearing source such as ilmenite which is a compound of ferrous oxide and titanium dioxide along with several other impurities, the ilmenite, after having been crushed to a desired mesh value, may be subjected to an oxidation step by being contacted with water at ambient temperature for a period of several days or by being contacted with an oxidizing gas such as oxygen or air at an elevated temperature for a period ranging from about 0.5 up to about several hours. The oxidized metal bearing source such as the ilmenite is then divided into two portions. One portion is then subjected to a reductive roast in the presence of a reductant which may comprise hydrogen, carbon monoxide, or mixtures thereof and, after having undergone the reductive roast for a period of time sufficient to effect a reduction of the metal bearing source at temperatures ranging from about 600° to about 1000° C., the metal bearing source is then subjected to an aqueous hydrogen chloride leach. The leaching of the metal bearing source is usually effected at elevated temperatures in the range of from about 80° to about 100° C. or more for a period of time which may range from about 0.25 to about 1 hour or more in duration. Upon completion of the leaching step the leached slurry is then subjected to precipitation by treating the slurry with the portion of the oxidized ore which was separated from the total portion of the ore and which was not subjected to the reductive roast. The addition of the oxidized source to the leached solution is also effected at elevated temperatures ranging from about 75° to about 105° C. while subjecting the mixture to agitation or stirring for a period of time which may range from about 2 minutes up to about 1 hour or more in duration and causes the dissolved titanium to precipitate as rutile.

The leach tails consisting of a mixture of unreacted ilmenite and rutile is then separated from the leach liquor. Following this the leach tails are then treated with water in an agitator. Inasmuch as the leaching of the reduced ore was effected in an acidic medium, the pH of the aqueous solution will be at a value less than 7 and usually will be in a range of from about 2 to about 4. After agitating the mixture for a period which may range from about 2 to about 10 minutes, the agitation is discontinued and the ilmenite is allowed to settle. The rutile which is present in the solution will remain in a suspended form and thus the settled ilmenite may be removed from the settler for retreatment.

Inasmuch as the leaching of the reduced ilmenite ore was effected in an acidic medium, the repulping of the rutile product with wash water in order to remove any acids which may still adhere to the solids will be in the pH range hereinbefore set forth. Due to the fact that the pH is on the acidic side and at a relatively low value, the wash water step will result in a stable suspension of the rutile in the wash water and it is therefore difficult to recover the rutile from the colloidal suspension. It has now been discovered that by adjusting the pH of the wash water to a value in excess of 7, and preferably in a range of from about 7.1 to about 10, it is possible to produce a flocculated rutile. The flocculation of the rutile will permit the product to be subsequently recovered in a more simple manner than has heretofore been possible. In addition, the acid which adhered to the rutile solids during the filtering and drying step will be washed away in said water wash and thus the rutile product will be in purer form.

The adjustment of the pH to a range greater than 7 and preferably in a range of from about 7.1 to about 10 is effected by the addition of a basic compound. The basic compound will comprise a salt of an alkali metal or alkaline earth metal and for the purposes of the present specification and appended claims will include oxides, hydroxides, and salts of weak acids. Some specific examples of these basic compounds which may be utilized will include sodium hydroxide, potassium hydroxide, lithium hydroxide, rubidium hydroxide, cesium hydroxide, magnesium hydroxide, calcium hydroxide, strontium hydroxide, barium hydroxide, magnesium oxide, calcium oxide, strontium oxide, barium oxide, sodium carbonate, potassium carbonate, lithium carbonate, rubidium carbonate, cesium carbonate, magnesium carbonate, calcium carbonate, strontium carbonate, barium carbonate, sodium acetate, potassium acetate, lithium acetate, rubidium acetate, cesium acetate, magnesium acetate, calcium acetate, strontium acetate, barium acetate, etc. It is to be understood that the aforementioned basic compounds are only representative of the class of compounds which may be employed and that the present invention is not necessarily limited thereto. The amount of basic compound which is added will be dependent upon the desired pH and will usually be in a range of from about 0.01 to about 1.0% by weight of the rutile.

The process of this invention may be effected in any suitable manner and may comprise a batch or continuous type operation. For example, when a batch type operation is to be employed, a quantity of the ilmenite ore is crushed to the desired mesh value and thereafter subjected to an oxidizing step for a period of time sufficient to oxidize the ore. Thereafter the ore is divided into two portions, one portion of which is subjected to a reductive roast in an appropriate apparatus such as an oven at an elevated temperature within the range hereinbefore set forth and in the presence of a reductant such as hydrogen, carbon monoxide, or mixtures thereof. After being reduced for a sufficient period of time, the reduced ilmenite ore is then removed from the oven and placed in an appropriate apparatus wherein it is subjected to a leach utilizing an aqueous hydrogen chloride solution. Upon completion of the leaching step the slurry is then treated with the portion of the oxidized ore which did not undergo reduction in order to precipitate the rutile. As was previously discussed the leaching and the precipitation are effected at elevated temperatures within the ranges discussed.

After precipitation of the rutile is completed, the solids are separated from the spent leach liquor and placed in a separation vessel wherein the solids are treated as an aqueous slurry at a pH less than about 7 in order to suspend both the rutile and the ilmenite. After agitating the solution containing the ilmenite and rutile particles for a predetermined period of time in the aforesaid aqueous suspension, the agitation is discontinued, allowing the ilmenite to settle from suspension while rutile remains suspended. After settling of the ilmenite, the concentrated rutile as a slurry is placed in a vessel wherein the pH is maintained in a range of from about 7.1 to about 10 by the addition of a basic compound of the type hereinbefore set forth in greater detail. The rutile will flocculate and thus may be separated from the wash water in a more simple manner of operation. Thereafter the flocculated rutile may be collected and treated in any suitable manner known in the art to recover the desired titanium dioxide in purified form.

It is also contemplated within the scope of this invention that the process may be effected in a continuous manner of operation. When such a type of operation is used the ilmenite ore which has been crushed to the desired mesh size is continuously charged to an oxidation zone wherein it is contacted with an oxidizing agent such as air at an elevated temperature for a predetermined period of time. After passage through the oxidative zone the ore is continuously withdrawn and divided into two portions, one portion of which is continuously charged to a reducing zone wherein a reduction of the ilmenite ore is effected at a temperature in the range of from about 600° to about 1000° C. The second portion of the ore is withdrawn and continuously charged to a precipitation zone hereinafter described in greater detail. After passage through the reducing zone such as an oven wherein the ilmenite is subjected to action of a reductant such as hydrogen, carbon monoxide, or a mixture of the two, the reduced ore is continuously withdrawn and passed to a leaching zone wherein the ore is contacted with an aqueous hydrogen chloride leach. After passage through the leaching zone which is maintained at an elevated temperature in the range of from about 80° to about 100° C., the pregnant leach liquor containing the soluble rutile in the form of titanium chloride, is continuously charged to a precipitation zone which is also maintained at an elevated temperature, usually in a range of from about 75° to about 105° C. In the precipitation zone the leach liquor is admixed with the oxidized ore which is also continuously charged thereto and which had been separated from a portion of the total ore charge after oxidation thereof. After a predetermined period of time in the precipitation zone the leach liquor containing the precipitated rutile and ilmenite is continuously withdrawn and passed to a separation zone wherein the solids are separated from the leach liquor. After separation from the spent leach liquor the solids are then continuously charged to a second separation zone wherein said solids are suspended in an aqueous slurry. After agitation in the second separation zone, the ilmenite ore particles are continuously removed from the bottom of the separation cell while the concentrated rutile solids are continuously withdrawn and continuously charged to a recovery zone, the pH of which is maintained above about 7. The flocculated ilmenite is then withdrawn from the recovery zone and treated to recover purified titanium dioxide.

The following examples are given for purposes of illustrating the process of this invention. However, it is to be understood that said examples are merely for purposes of illustration and that the present process is not necessarily limited thereto.

EXAMPLE I

In this example a natural ilmenite ore was ground to about −65 mesh. The ore was oxidized by treatment with air at a temperature of about 750° C. for a period of 1 hour. Following this the ore was divided into two separate portions, one portion being subjected to a reductive roast in a reducing atmosphere comprising a mixture of hydrogen and carbon monoxide at a temperature of about 750° C. The ilmenite was then subjected to an aqueous hydrogen chloride leach at a temperature of about 100° C. for a period of 0.25 hours. The pregnant leach liquor was then admixed with the second portion of the oxidized ore which had not been subjected to the reductive roast and agitated for a period of about 0.25 hours.

The rutile product was separated from the spent leach liquor, slurried in wash water and allowed to stand for a period of several days. However, the rutile formed a stable colloidal suspension which did not settle out. The pH of the slurried rutile was determined to be less than 7.

EXAMPLE II

In this example an ore sample similar in nature to that described in Example I was treated in an identical manner down through the precipitation of the rutile by treatment of the leach liquor with a portion of the oxidized ore. The rutile which was recovered as the product was again slurried with 200 cc. of water and the pH of the solution was adjusted to 8 by means of the addition of a sufficient amount of sodium hydroxide. The rutile flocculated rapidly and within 2 hours the solution clarified, the flocculated rutile being easily recovered from the solution.

EXAMPLE III

To illustrate the separation of ilmenite from rutile which may be effected at a pH less than about 7, a 50 gram sample of leach tails which had been obtained by utilizing a process set forth in the above examples was slurried in about 200 cc of water at a pH of about 2.5 and after agitation for a period of about 5 minutes was allowed to settle. After allowing the solution to stand for a period of 3 minutes, the slimes which comprise suspended solids were separated from the settled solids and recovered by raising the pH of the slurry to 8, causing the suspended slimes to flucculate. The flocculated slimes were then easily separated from the water. X-ray analysis of the flocculated slimes detected a strong rutile constituency, while chemical analysis showed the presence of a minor amount of iron, vanadium, cobalt, chromium and aluminum. X-ray analysis of the tails which had been used as the starting material showed a strong ilmenite pattern with a moderately weak pattern for sericite which is a silica mineral. The sink which comprised the settled solids consisted of ilmenite and silica minerals and showed, upon X-ray analysis, a strong ilmenite pattern with large crystals. Therefore, it is apparent that a separation of a major portion of the ilmenite from the rutile may be accomplished while a further purification of the rutile is effected by treating the slimes in a manner similar to that hereinbefore set forth.

We claim as our invention:

1. A method for the separation of rutile which comprises the steps of:

(a) agitating a slurry of leach tails containing a mixture of ilmenite and rutile;

(b) allowing said slurry to settle;

(c) decanting the suspended rutile from the settled ilmenite;

(d) adjusting the pH of the decanted, suspended rutile solution to effect the flocculation of said rutile; and (e) recovering the flocculated rutile.

2. The method as set forth in claim 1 in which the agitation of said slurry of leach tails is effected at a pH less than 7.

3. The method as set forth in claim 2 in which said pH is in a range of from about 2 to about 4.

4. The method as set forth in claim 1 in which the flocculation of said suspended rutile is effected at a pH in excess of 7.

5. The method as set forth in claim 4 in which the pH of the solution is maintained in the range of from about 7.1 to about 10.

6. The method as set forth in claim 4 in which said pH is provided for by the presence of a basic compound.

7. The method as set forth in claim 4 in which said basic compound is a salt of an alkali metal or alkaline earth metal.

8. The method as set forth in claim 4 in which said basic compound is sodium hydroxide.

9. The method as set forth in claim 4 in which said basic compound is potassium hydroxide.

10. The method as set forth in claim 4 in which said basic compound is calcium oxide.

* * * * *